US006220939B1

(12) United States Patent
Pruitt

(10) Patent No.: US 6,220,939 B1
(45) Date of Patent: Apr. 24, 2001

(54) METHOD AND APPARATUS FOR GRINDING ROUND PARTS

(76) Inventor: James E. Pruitt, 1402 Rural St., Rockford, IL (US) 61108

( * ) Notice: Subject to any disclaimer, the term of this patent is extended or adjusted under 35 U.S.C. 154(b) by 0 days.

(21) Appl. No.: 09/324,270

(22) Filed: Jun. 2, 1999

Related U.S. Application Data

(60) Provisional application No. 60/087,704, filed on Jun. 2, 1998.

(51) Int. Cl.[7] ..... B24B 1/00

(52) U.S. Cl. ..... 451/49; 451/51; 451/242

(58) Field of Search ..... 451/49, 50, 51, 451/242, 243, 331, 332, 333, 401, 397, 398

(56) References Cited

U.S. PATENT DOCUMENTS 3,859,756 * 1/1975 Zerbola ..... 451/49
4,531,327 * 7/1985 Dzewaltowski et al. ..... 451/401
5,094,037 * 3/1992 Hakomori et al. ..... 451/401
5,161,332 * 11/1992 Koch ..... 451/401

* cited by examiner

*Primary Examiner*—Derris H. Banks
(74) *Attorney, Agent, or Firm*—Keith Frantz

(57) ABSTRACT

A rotating fixture includes work piece holders for carrying work pieces in a circular path for parading the work pieces one-by-one for machining engagement with a grinding wheel. The work pieces holders permit rotation or spinning of the work piece therein independently of the fixture rotation. A drive wheel engages and spins each work pieces in the holder as the work piece travels through machining engagement with the grinding wheel such that a round, outside-diameter surface is ground onto the work piece.

15 Claims, 9 Drawing Sheets

METHOD AND APPARATUS FOR GRINDING ROUND PARTS

This application claims the benefit of U.S. Provisional No. 60/087,704 filed Jun. 2, 1998.

BACKGROUND OF THE INVENTION

1. Field of Invention

The present invention relates generally to methods and apparatus for machining round parts. More particularly, the invention relates to methods and apparatus for grinding outside-diameter surfaces onto parts with an OD grinder, and which is especially useful in an automated or semi-automated grinding operation for continuously feeding parts to the grinder.

2. Description of Prior Art

Conventional methods for grinding an outer diameter surface onto a part are generally manual in nature, such as typically having a machine operator manually position a part on a guide or in a fixture associated with an OD or centerless grinder, and then grind the desired surface onto that part. The part is then removed from the grinder, and another part is inserted for grinding. This manual operation is carried out one piece at a time and is a relatively slow process.

For economic reasons, there is an ever-present need to increase productivity rate for grinding outside-diameter round surfaces onto parts. Thus, there is an ever-present need for improved methods for and apparatus to assist in grinding such round surfaces onto parts at a faster rate.

SUMMARY OF THE INVENTION

The general aim of the present invention is to provide new and improved methods and apparatus for grinding round, outside-diameter surfaces onto parts in a manner which increases productivity rates over conventional grinding methods, and thus reduce the associated cost of machining the parts.

A detailed objective is to achieve the foregoing by providing a fixture having a plurality of work piece holders in closely spaced relation, each holder being adapted to slidably receive and rotatably carry a work piece, the fixture being further adapted to parade the holders in continuous succession past a grinding wheel to carry the work pieces into rotating grinding engagement therewith for grinding the desired outside-diameter surfaces.

Another detailed objective of the invention is to automatically secure the work pieces in the fixture during engagement with the grinding wheel and to automatically release the finished part thereafter for ease of removal from the fixture.

These and other objectives and advantages of the invention will become more apparent from the following detailed description when taken in conjunction with the accompanying drawings.

Briefly, a machine includes a rotating circular fixture that is adapted to releasably carry work pieces, one at a time, into rotating machining engagement with an OD grinding wheel for machining the desired OD surface onto the part. In this instance, the fixture includes a generally round base that is mounted for continuous rotation about a first horizontal axis by, for example, an electric motor, the base being equipped with work piece holding mechanisms in relatively closely spaced relation on an outer diameter thereof. As the base rotates, work pieces are slidably inserted into each holding mechanism as they pass through a loading station area near the front of the machine proximate the machine operator. The work pieces are then carried in the holders in a circular path, as the base rotates, into rotating grinding engagement with the grinding wheel for grinding the desired surface. The fixture also includes a drive roller that is mounted for continuous rotation about a second horizontal axis, and is positioned to engage the work piece as it approaches and passes by the grinding wheel, for controlled rotation of the work piece about its center in the holder during and to maintain grinding engagement with the grinding wheel. Thereafter, the base rotates the part back toward the front of the machine where the finish ground part is removed and another part is installed into the vacated holder. Thus, work pieces are paraded in continuous succession through the grinding operation to achieve relatively high productivity rate.

Figure 1:
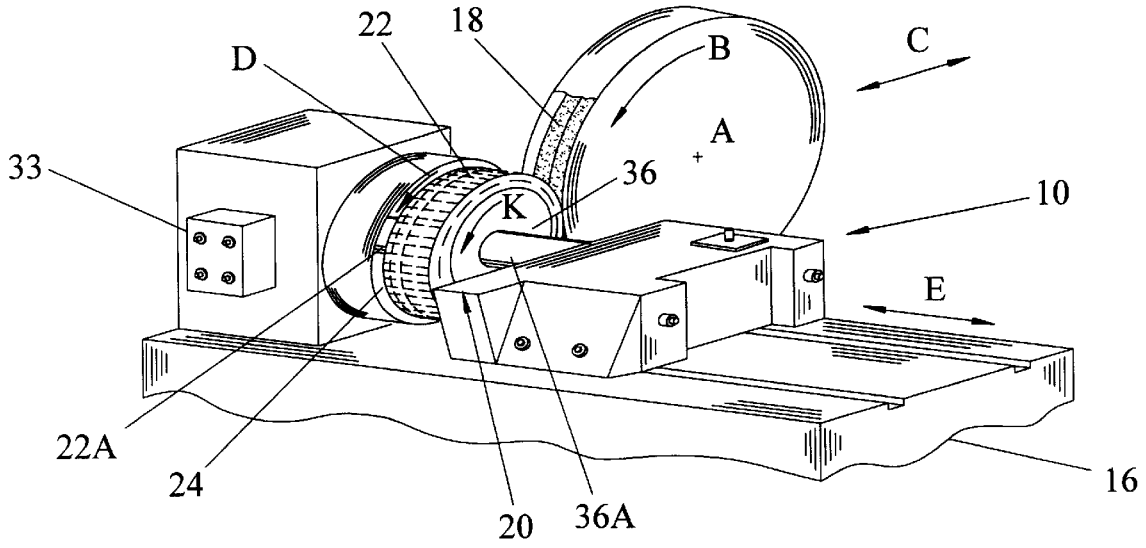
FIG. 1 is a perspective view of a grinding machine incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

Figure 2A:
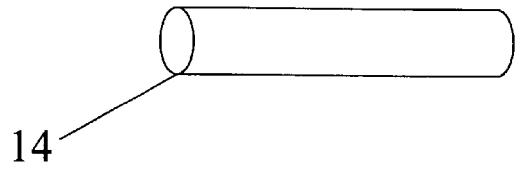
FIGS. 2(A & B) and 3(A & B) are perspective views of sample work pieces for grinding in a machine according to the invention.
Figure 2B:
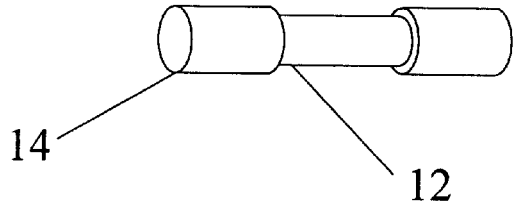
Figure 3A:
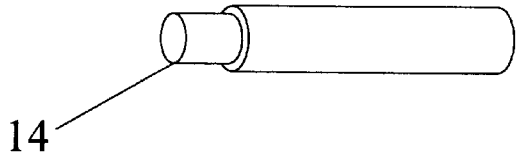
Figure 3B:
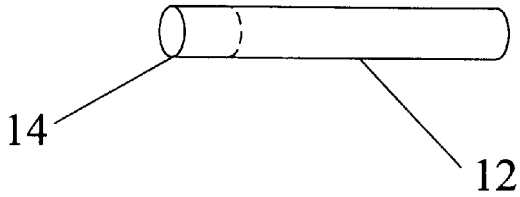

For purposes of illustration, the present invention is shown in the drawings in connection with a machine 10 (FIG. 1) adapted to grind outside-diameter surfaces 12 onto generally round work pieces 14. For illustrative purposes only, sample unfinished work pieces are shown in FIGS. 2A and 3A, and associated finished work pieces shown in FIGS. 2B and 3B.

In general, the machine 10 includes a supporting frame structure or base 16 resting on the floor (not shown), a power rotated fixture 20 adapted to releasably hold the work pieces 14, and a conventional grinding wheel 18 that (i) is mounted for rotation in the direction indicated by arrow "B" about a vertical axis extending through the center thereof as indicated at "A", (ii) is power rotated, by for example an electric motor (not shown), for grinding the work pieces, (iii) is substantially enclosed for safety, and (iv) is adapted for forward and backward translation toward and away from the base as indicated by arrow "C", and optionally for lateral translation as indicated by arrow "E", to permit selective positioning of the grinding wheel relative to the fixture. Control switches indicated generally at 33 control the operation of the machine, including the grinding wheel and the other components described herein.

In accordance with the present invention, the fixture 20 is uniquely adapted to carry the work pieces 14 in continuous procession for controlled rotating engagement with the grinding wheel 18 for machining the desired outside-diameter surfaces 12 onto the work pieces.

Figure 4:
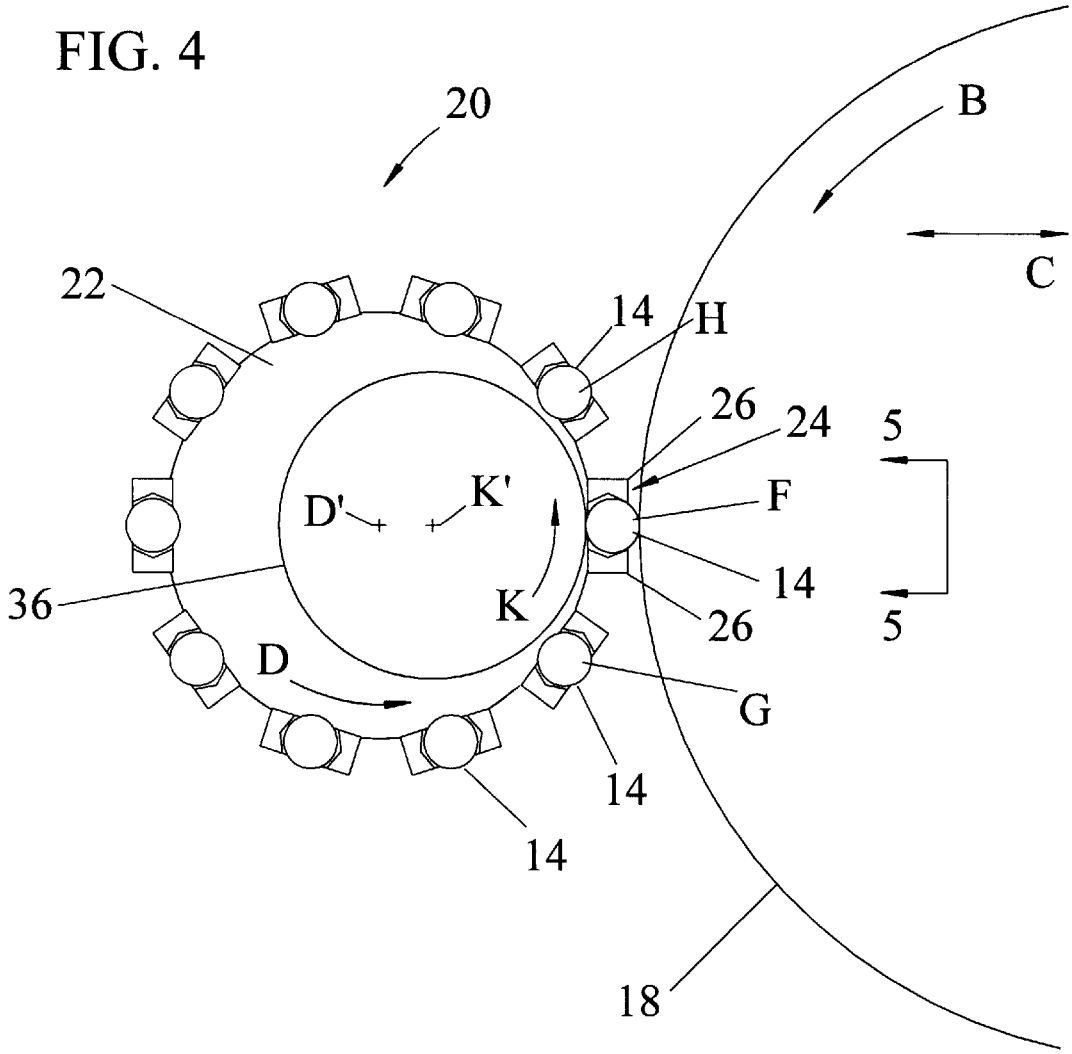
FIG. 4 is a side view of a fixture and certain other parts of the machine of FIG. 1.
Figure 8:
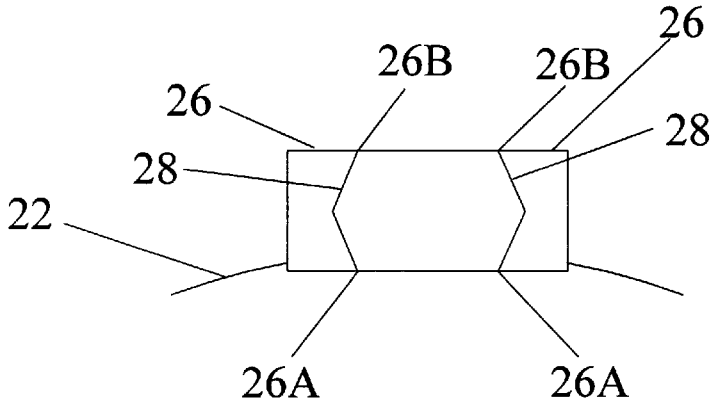
FIG. 8 is a is a view taken substantially along the line 8—8 of FIG. 5.
Figure 5:
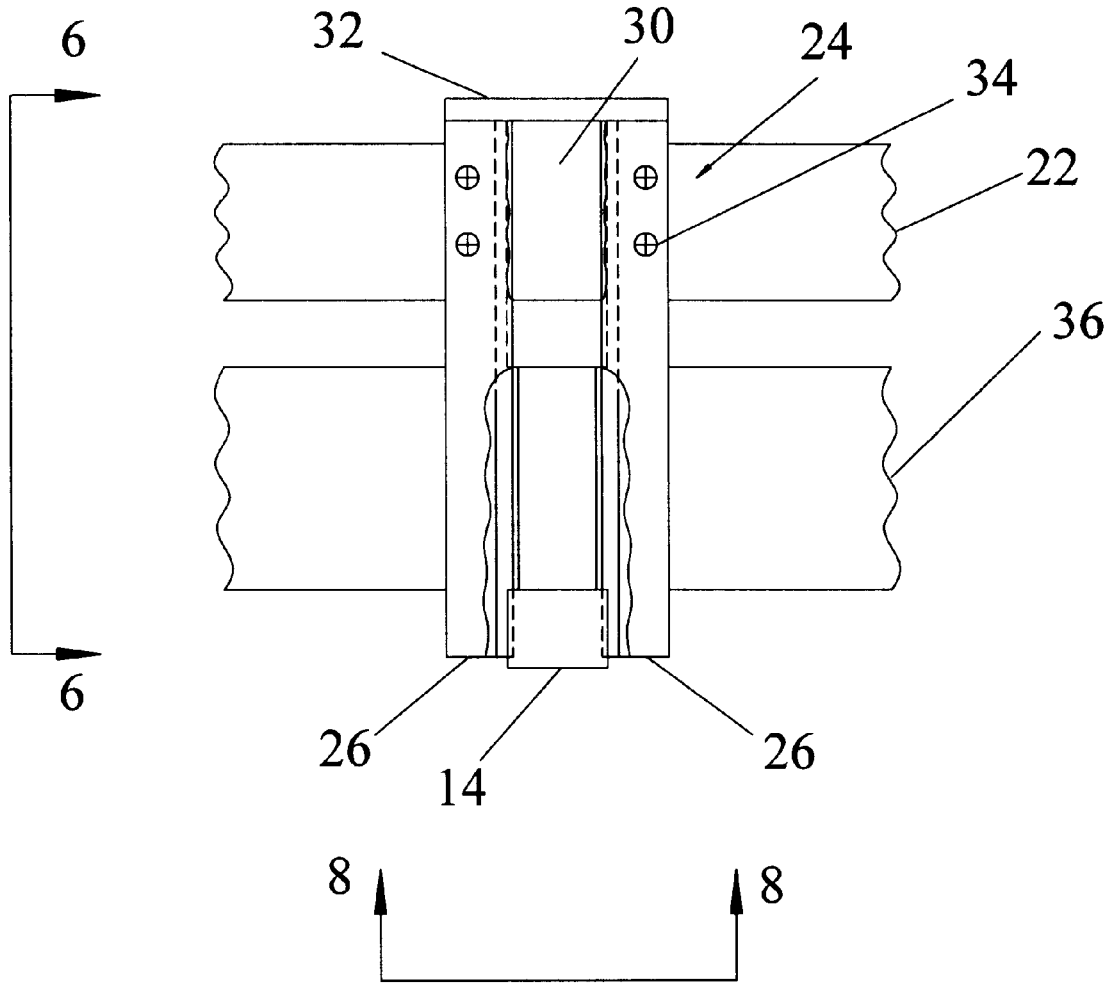
FIG. 5 is a view taken substantially along the line 5—5 of FIG. 4.

In generally carrying out the invention, and as generally illustrated in FIG. 4, the fixture 20 includes a generally circular, power rotated base 22 driven by, for example, an electric motor through shaft 22A and adapted to releasably carry (as discussed further below) a number of parts 14 in a circular path into rotating machining engagement with the grinding wheel 18. As the fixture rotates as designated as "D", each part approaches and then engages the grinding wheel to grind the desired surface 12 onto the work piece, after which that work piece rotates past the grinding wheel. The finished part is then carried to an unloading station near the front of the machine 10 and proximate the operator where the finished part is removed, and another part is installed into the fixture. Thus, as the fixture rotates, one-by-one each part on the fixture rotates from the loading station, into machining engagement with the grinding wheel and then to the unloading station.

As also indicated in FIG. 4, the parts 14 are rotatably carried on the fixture 20 in a manner that provides for controlled spinning of the parts in the fixture in the direction indicated as "F" generally between the loading and unloading stations, and in particular at least during machining engagement with the grinding wheel 18, and such that the parts stop spinning for unloading of finished parts. In this instance, each part begins to rotate or spin about its center and on the fixture prior to reaching the grinding wheel such as indicated at "G", the part continues to spin as it is carried through machining engagement with the grinding wheel and until the part is carried past the grinding wheel such as at "H" whereupon spinning of the part ceases.

In further carrying out the invention, the fixture includes a plurality of holding mechanisms or holders 24 for the work pieces 14, each holder being connected to an outer diameter of the base 22 and being adapted to slidably receive a work piece for carrying the work pieces in a circular path on the rotating fixture, and to rotatably carry the work pieces for spinning of each part about its center as the part is carried into engagement with the grinding wheel.

In one embodiment shown in FIGS. 4–7, each holding mechanism 24 includes a pair of jaws or braces 26 connected to the OD of the base 22 and extending laterally therefrom. The braces are formed with facing surfaces 28 that define a slot for slidably receiving and rotatably supporting the work piece 14 therebetween. In the embodiment shown, the mating surfaces are generally in the form of facing V-shapes to create a laterally extending space for slidably receiving the part through the free, open end thereof. At the opposite end of the slot is shown a spacer 30 (FIG. 5) that may be connected to the base via an end cap 32 connected with threaded fasteners 34 for establishing the lateral positioning of the part in the braces and relative to the grinding wheel. In this instance, the work piece is slipped into between the braces to a depth allowed by the free end of the spacer. The work piece is then trapped between the braces, between the radially inner facing edges 26A and the radially outer facing edges 26B, but with clearance for some radial (with respect to the center D' of the base 22) movement or translation therebetween. Although only one pair of braces 26 is shown in FIG. 4, it will be understood that multiple holders or multiple pairs of braces are preferably spaced along the entire OD of the base, as generally indicated by the dashed lines in FIG. 4., for carrying the multiple work pieces on the fixture. As will also be evident to the skilled artisan, other methods and arrangements may also be used to achieve a desired lateral positioning of the work pieces in the holders such as positioning the braces radially inwardly and utilizing the adjacent surface of the base 22 to limit lateral movement of the work piece.

In carrying out yet another aspect of the invention, the fixture includes drive means for engaging and spinning the work pieces 14 as they approach and travel through machining engagement with the grinding wheel 18. Such drive means causes the parts to spin at a controlled speed to effect the machining of the desired outside-diameter surface 12. The controlled lower-speed spinning of the part prevents the parts from simply spinning at a high speed that would otherwise result from surface contact with the grinding wheel, in which case, the part would simply spin and machining of the desired surfaces 12 would not occur.

The drive means in FIG. 4 includes a drive wheel 36 that is located within the circular path of the work pieces 14 on the base 22. The drive wheel is continuously rotated by, for example, an electric motor, by shaft 36A in the direction designated as "K" about its center K', independently of the fixture base 22 and work pieces, and is positioned to engage each part as the part approaches the grinding wheel such as at "G", to continue to engage the part as it travels through machining engagement with the grinding wheel, and until the part is carried past the grinding wheel such as at "H". Thus, drive wheel engagement and controlled driving or spinning of work pieces occurs for each part as it approaches and travels through engagement with the grinding wheel. In other words, the drive wheel stays in driving contact with each part throughout the grinding operation on that part. For certain sized drive wheel, base and work piece diameter combinations, and possibly including other holding mechanisms such as described below, the drive wheel may be optionally spring-loaded (see FIG. 9) generally in the direction of the grinding wheel to assist in providing tracking of the drive wheel with the work pieces as they approach and travel through grinding engagement with the grinding wheel.

Figure 6:
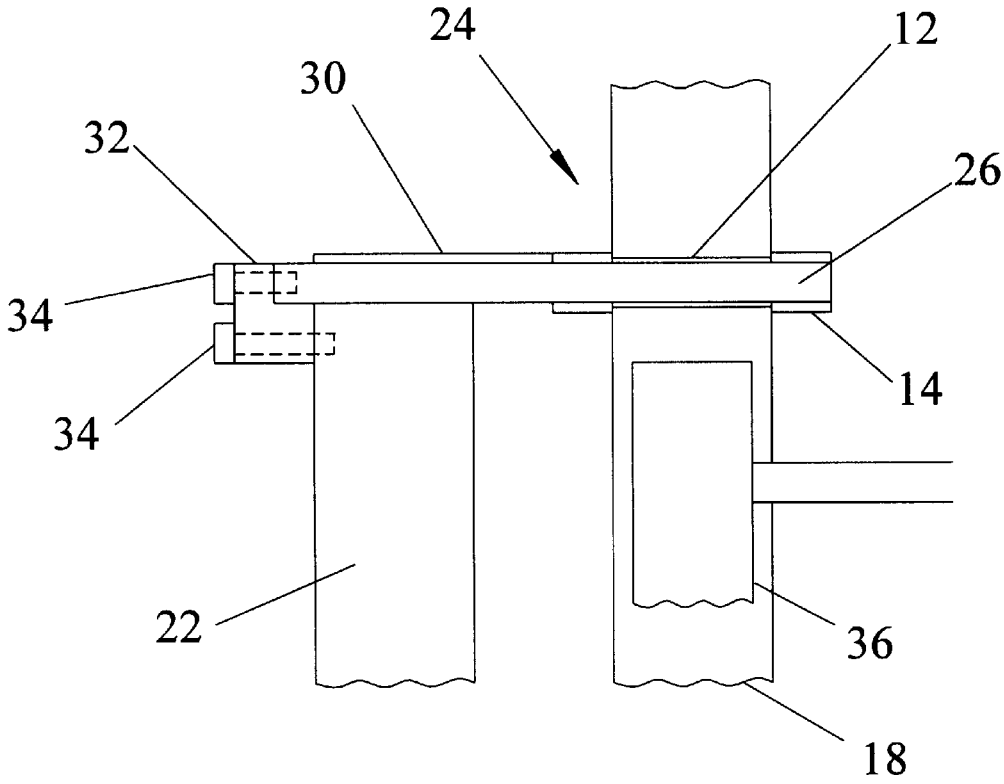
FIG. 6 is a is a view taken substantially along the line 6—6 of FIG. 5.
Figure 7:
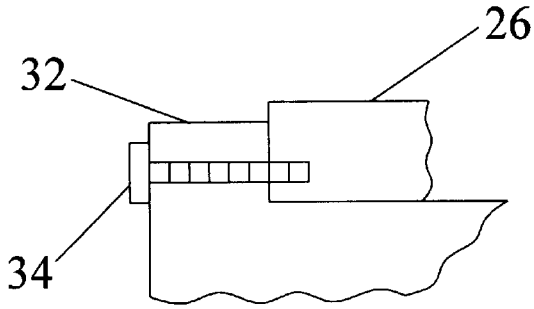
FIG. 7 is an enlarged view of certain parts of FIG. 6.

As can be seen in FIG. 6, in this embodiment, the fixture base 22 is off-set laterally from the grinding wheel 18, and the power rotated drive wheel 36 is generally aligned with the grinding wheel. With this arrangement, the drive wheel engages the part for controlled speed spinning just prior to and as it rotates through engagement with the grinding wheel, and the part stops spinning as it rotates past the drive wheel. As will be evident, the diameter of the finished surface of the work piece is established by the distance between the OD of the drive wheel and the OD of the grinding wheel. Advantageously, rotatably carrying the part between the braces or an equivalent holding arrangement, and then driving or at least limiting the spinning of the parts about their axis, eliminates the potential spinning surface contact between the work piece and the grinding wheel.

Alternate work piece holding mechanisms may also be utilized with the fixture 20, such mechanisms permitting controlled spinning of the work pieces 14, and preferably being adapted to slidably receive the work pieces for ease of installation and removal from the fixture.

One alternate holding mechanism embodiment is shown in FIGS. 9–12. In this instance, each holder 50 includes an arm or pair of arms 52 and an idler roller or rollers 54. The arm is connected to the fixture base with a pin 56 such that the arm is pivotable on the fixture as indicated at "M", and is spring 60 biased with, for example a coil spring 58 connected and acting between the base 22 and the arm 52 to loosely clamp the part 14 against the OD of the fixture base 22. The idle roller 54 is connected to the base for free spinning. Thus, each holder arrangement 50 comprising the arm 52, spring 58 and idler 54, as well as the part therein, rotates on the circular path with the fixture base. The drive wheel 36A is positioned to engage the work pieces 14 for controlled spinning as they each approach grinding engagement with the grinding wheel 18, and is in this instance preferably spring loaded with spring 58 generally toward the grinding wheel to assist in providing tracking of the drive wheel with the work pieces as they approach and travel through grinding engagement with the grinding wheel. With this arrangement, the work piece may be positioned into the holder, between the arms 52 and the idle rollers 54 by pressing the work piece in a generally tangential to the circumference of the base 22, causing the arm to pivot against the spring bias to allow entry of the part, after which the spring-biased arms retain the part in position on the fixture.

Figure 9:
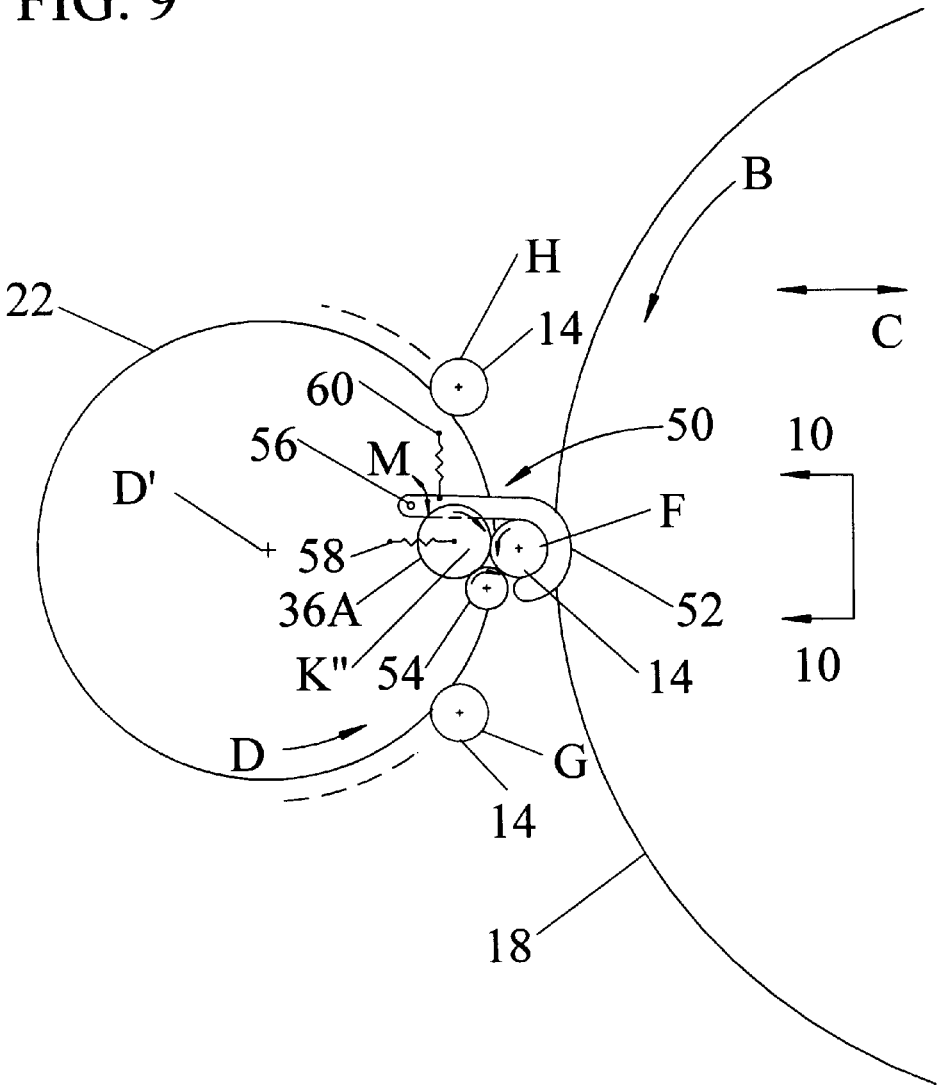
FIG. 9 is a view similar to FIG. 4 of an alternate embodiment of the invention.
Figure 10:
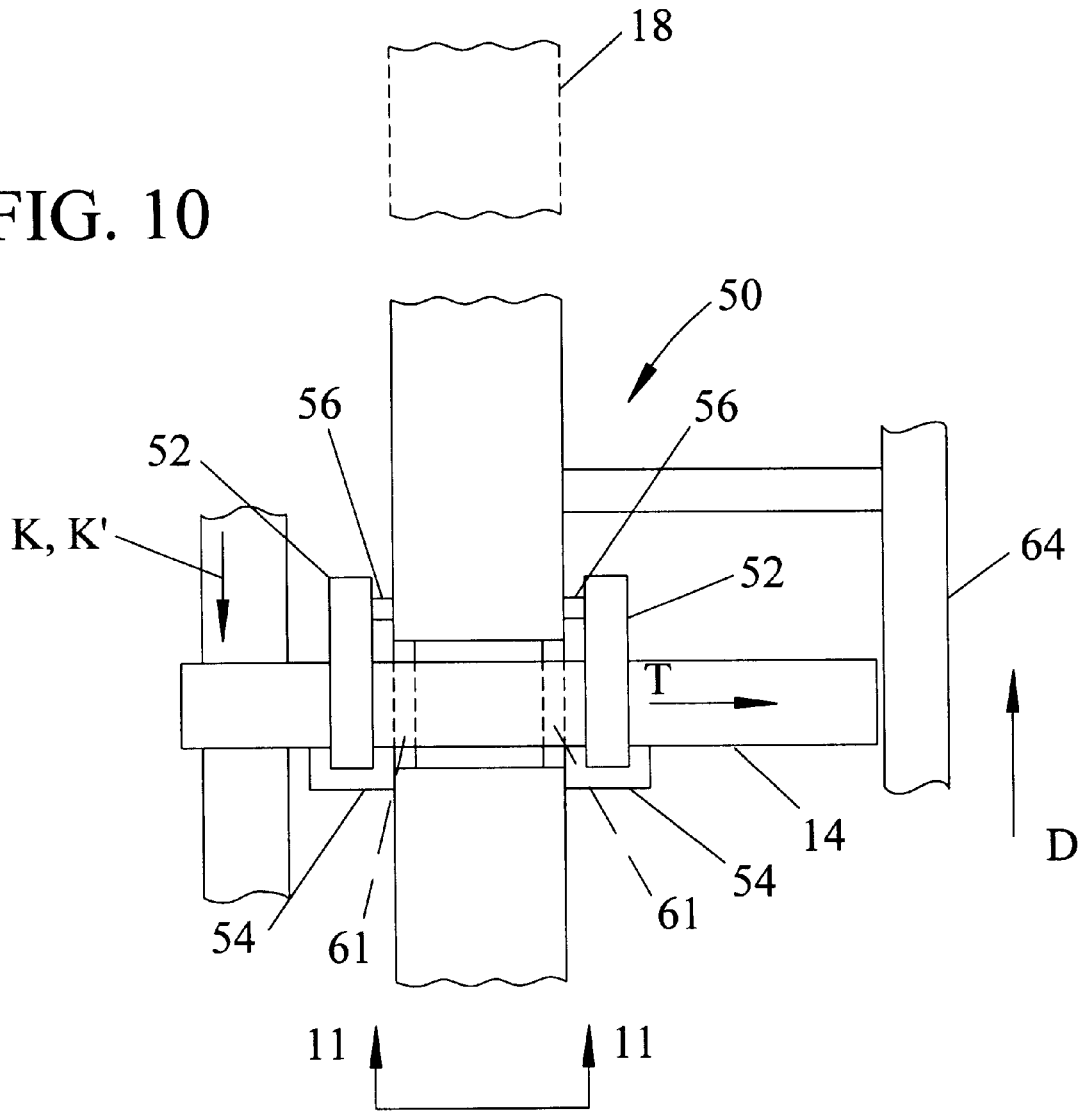
FIG. 10 is a is a view taken substantially along the line 10—10 of FIG. 9.
Figure 11:
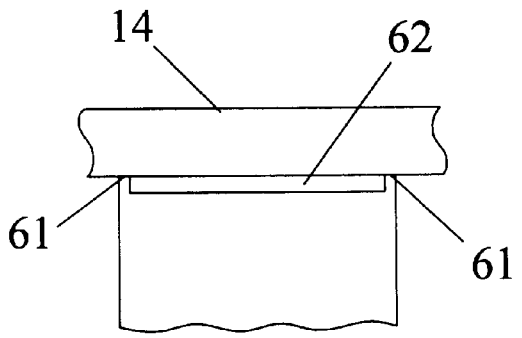
FIG. 11 is a is a view taken substantially along the line 11—11 of FIG. 10.
Figure 12:
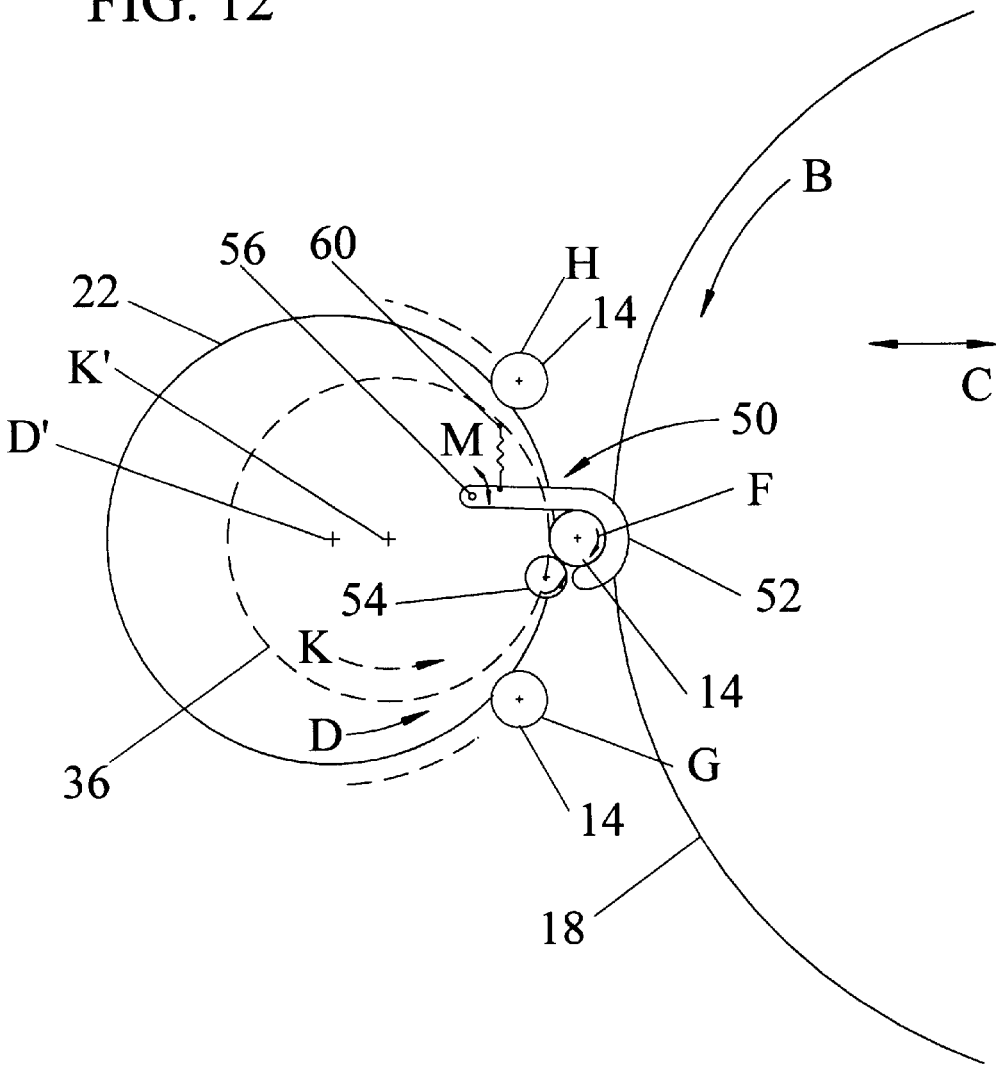
FIG. 12 is a view similar to FIG. 9 of a second alternate embodiment of the invention.

In the instance of the work piece 14 resting on the OD of the base 22, and as shown in FIG. 11, the OD of the base may optionally include wear support surfaces 61 that are raised above a relief cut 62 in the fixture to support the spinning part on relatively short surface lengths to reduce the spinning friction between the spinning part and the fixture. The embodiment shown is also equipped with a stop plate 64 to establish a lateral position or limit on side-to-side movement of the work piece in the fixture in at least one of the two lateral directions such as designated at "T", and particularly during the time the part is spinning and through the grinding operation. It is noted that in certain instances, such as indicated in FIG. 9, it may be desirable to rotate the drive wheel in a direction opposite the direction of rotation of the base 22. The embodiment shown in FIG. 12 illustrates the use of the larger drive wheel 36 with the holding arrangement of FIG. 9.

Figure 13:
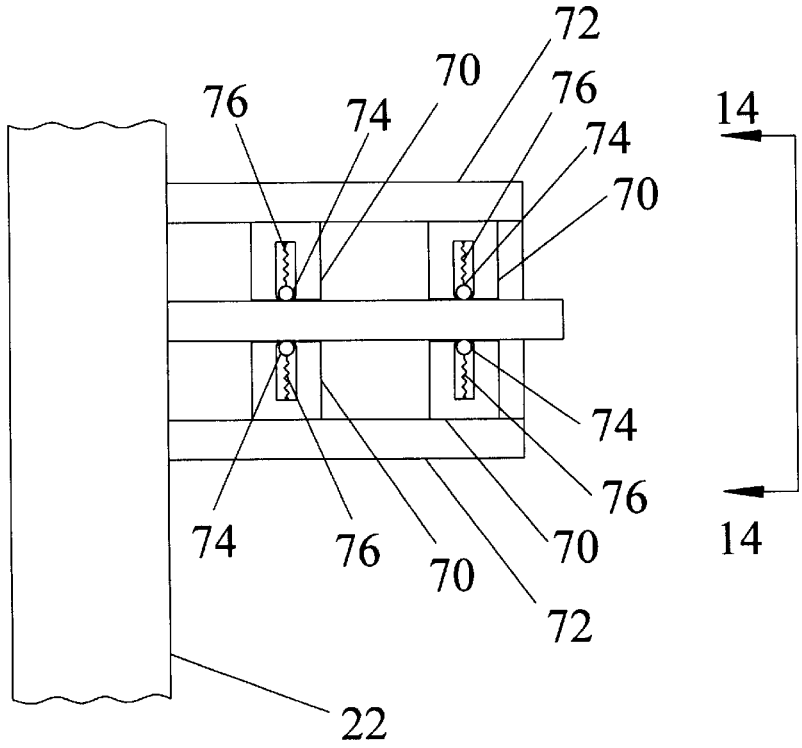
FIG. 13 is a view similar to FIG. 6 of a third alternate embodiment of the invention.
Figure 14:
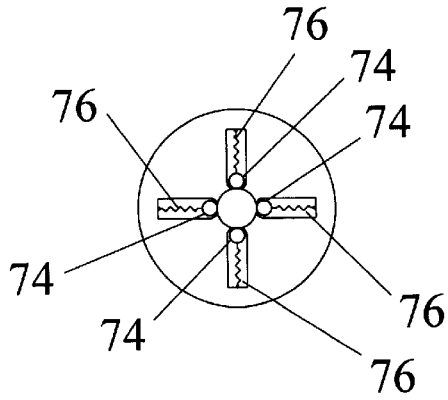
FIG. 14 is a veiw taken substantially along the line 14—14 of FIG. 13.

In yet another alternate embodiment, the work pieces 14 may be rotatably carried in a pair of collars 70 (FIGS. 13–14) connected to the OD of the fixture base 22 as indicated at 72. One such suitable-type collar is equipped with radially inwardly spring 76 biased balls 74 for centering the part therein and for quick installation and removal from the fixture. In this instance, the collars are positioned to provide for work piece engagement with the grinding wheel, and the drive wheel as previously described for controlled work piece spinning through the grinding operation. Such an arrangement is likely especially suitable for use with relatively small work pieces.

Provision may also be included for imparting a lateral-biasing force such as indicated at "T" on the work piece as it proceeds through the grinding operation for insuring that the part is biased against the spacer 30, the stop plate 64, or the inside surface of the base 22 as the case may be, and thus insure desired lateral positioning of the part in the holder during the grinding operation. Such lateral-biasing means may be provided by, for example, providing an appropriately angled surface toward the stop or spacer such as the support surfaces 61, the radial outer edges 26B of the braces, or forming the desired biasing angle onto the drive wheel 36. Such provision will tend to drive the work piece toward and maintain it against the spacer during the grinding operation.

The skilled artisan will recognize that the methods and apparatus disclosed herein may be further modified for machining round surfaces 12 onto work pieces 14 through other alternate embodiments that remain within the scope of the present invention. Such artisans will also recognize that a machine equipped with a fixture in accordance herewith may also be provided with automatic unloading of finished work pieces, such as discussed in U.S. patent application Ser. No. 09/078,855, and other known timed discharge methods, as well as providing for automatic loading of work pieces such as with conventional parts feeders and associated timing mechanisms.

From the foregoing, it will be apparent that the present invention brings to the art new and improved methods and apparatus for grinding round, outside-diameter surfaces onto work pieces. By continuously parading work pieces through engagement with a grinding wheel, the work pieces being rotatably carried in a fixture adapted to provide for controlled spinning of the parts during the grinding operation, the productivity of grinding round surfaces onto the work pieces is substantially enhanced over prior methods and apparatus for grinding such surfaces.

I claim:

1. A machine for machining an outside diameter portion of a work piece, said machine comprising:

a fixture;

means for rotating the fixture about a first axis;

a plurality of work piece holders connected to said fixture for rotation therewith, each holder being adapted to slidably receive a work piece;

a cutting tool positioned for machining engagement with said outside diameter portions of associated work pieces as said work pieces rotate with the fixture;

means for spinning the work pieces in the holders independently of the fixture during said machining engagement; and means for clamping the spinning work pieces in the holders during said machining engagement and for releasing the spinning work pieces after said machining engagement.

2. A machine as defined in claim 1 in which said clamping means and said spinning means includes a rotating drive wheel operatively engaging the work pieces as they approach and pass through said machining engagement with the cutting tool.

3. A machine as defined in claim 2 in which said drive wheel rotates about a second axis located between said first axis and said cutting tool.

4. A machine as defined in claim 2 in which said drive wheel is spring biased into clamping and spinning engagement with the work pieces during said machining engagement.

5. A method for machining an outside diameter surface onto a work piece with a cutting tool, said method comprising the steps of:

rotating the work piece through a circular arc that passes proximate the cutting tool to establish machining engagement therebetween;

clamping the work piece in fixed relation to said arc during said machining engagement;

spinning the clamped work piece; and machining the outside diameter surface onto the spinning work piece.

6. A machine for machining a work piece having first and second outside diameter portions, said machine comprising:

a fixture;

means for rotating the fixture about a first axis;

a plurality of work piece holders connected to said fixture for rotation therewith, each holder being adapted to slidably receive a work piece and having means for engaging said first outside diameter portion of the work piece for retention of the work piece in the rotating holder;

a cutting tool positioned for machining engagement with said second outside diameter portions of associated work pieces as said work pieces rotate with the fixture; and means for spinning the work pieces in the holders independently of the fixture during said machining engagement.

7. A machine as defined in claim 6 in which said engaging means is adapted to engage the work piece in radial spaced relation such that said first diameter portion extends longitudinally along the work piece.

8. A machine as defined in claim 7 in which said engaging means includes an axially extending slot sized to slidably receive the work piece.

9. A machine as defined in claim 7 in which said engaging means includes a pair of jaws extending axially and spaced radially on either side of the work piece to define said slot.

10. A machine as defined in claim 6 in which said engaging means is adapted to engage the work piece in longitudinal spaced relation such that said first diameter portion extends circumferentially along the work piece.

11. The machine as defined in claim 10 in which said engaging means includes a pair of axially spaced arms adapted to slidably receive and wrap around said first diameter portion of the work piece.

12. A machine as defined in claim 10 further comprising means for clamping the spinning work pieces in the holders during said machining engagement and for releasing the work pieces after said machining engagement.

13. A machine for machining an outside diameter portion of a work piece, said machine comprising:

a fixture;

means for rotating the fixture about a first axis;

a plurality of work piece holders connected to said fixture for rotation therewith, each holder being adapted to slidably receive a work piece;

a cutting tool positioned for machining engagement with said outside diameter portions of associated work pieces as said work pieces rotate with the fixture;

means for spinning the work pieces in the holders independently of the fixture during said machining engagement; and means for biasing the spinning work pieces into a first position during said machining engagement.

14. A machine as defined in claim 13 in which said biasing means is adapted to bias the work pieces axially into alignment with the cutting tool.

15. A machine as defined in claim 13 in which said biasing means is adapted to bias the work pieces radially for establishing the outside diameter portions during said machining engagement.

* * * * *